US007686670B2

(12) United States Patent
Wong

(10) Patent No.: US 7,686,670 B2
(45) Date of Patent: Mar. 30, 2010

(54) DOLL

(75) Inventor: Tak Ko Wong, Kwun Tong (HK)

(73) Assignee: T. K. Wong & Associates Ltd., Hong Kong SAR (CN)

( * ) Notice: Subject to any disclaimer, the term of this patent is extended or adjusted under 35 U.S.C. 154(b) by 479 days.

(21) Appl. No.: 11/416,670

(22) Filed: May 3, 2006

(65) Prior Publication Data

US 2007/0232185 A1 Oct. 4, 2007

(30) Foreign Application Priority Data

Mar. 30, 2006 (GB) ..... 0606373.9

(51) Int. Cl.
*A63H 3/36* (2006.01)
*A63H 3/00* (2006.01)

(52) U.S. Cl. ..... 446/385; 446/390

(58) Field of Classification Search ..... 446/267, 446/268, 369, 385, 390
See application file for complete search history.

(56) References Cited

U.S. PATENT DOCUMENTS

| | | | | |
|---|---|---|---|---|
| 2,606,398 | A * | 8/1952 | Miller | 446/385 |
| 4,883,442 | A * | 11/1989 | Kaplan | 446/320 |
| 5,026,054 | A * | 6/1991 | Osher et al. | 473/594 |
| 5,066,259 | A * | 11/1991 | Acker | 446/385 |
| 2004/0082718 | A1 * | 4/2004 | Chan et al. | 525/88 |

* cited by examiner

*Primary Examiner*—Kien T Nguyen
(74) *Attorney, Agent, or Firm*—Jackson Walker, LLP

(57) ABSTRACT

A doll has a figure of a human or an animal and an outer layer of a flexible gelatinous compound covering the figure so as to provide a skin-like characteristic. The figure may have a part that is made of a soft resilient material and in covering that part the gelatinous compound is bonded to a stretchy elastic textile.

7 Claims, 3 Drawing Sheets

DOLL

FIELD OF THE INVENTION

The current invention relates to dolls. More particularly the invention relates to toy dolls, to collectable dolls, and also to toy animals and other creatures.

BACKGROUND TO THE INVENTION

Dolls are a favorite among young children, teenagers and even adults. Young children like plush or soft toy dolls having fabric coverings. However among older children, teenagers and adults some prefer more lifelike collectable dolls. Hitherto that has been difficult to make a doll having a realistic skin-like outer covering.

SUMMARY OF THE INVENTION

It is an object of the present invention to provide a doll having a realistic outer skin-like covering, or at least to provide a doll having an improved outer covering that provides the public with a useful alternative.

There is disclosed herein a doll comprising a figure of a human or an animal and an outer layer covering the figure so as to provide a skin-like characteristic to the figure, wherein the outer layer comprises a flexible gelatinous compound.

There is also disclosed herein a doll comprising a figure of a human or an animal having at least one soft part comprising a soft resilient material, and an outer layer covering the soft part so as to provide a skin-like characteristic to the soft part, wherein the outer layer comprises a flexible gelatinous compound bonded to a stretchy elastic textile.

Preferably, the gelatinous compound was formed by a molding process and was bonded to the stretchy elastic textile during the molding process.

Preferably, the gelatinous compound was formed by a molding process and is bonded to the stretchy elastic textile by an adhesive.

Preferably, the stretchy elastic textile is a spandex or elastine.

Preferably, the gelatinous compound is between 3 and 15 millimeters thick.

Preferably, the gelatinous compound consists of SEEPS or SEBS and a mineral oil in a ratio of between 1:5 and 1:30.

Preferably, tackiness of the gelatinous compound was removed by the introduction of an antioxidant during the compounding process.

Further aspects of the invention will become apparent from the following description which is given by way of example to illustrate the invention.

BRIEF DESCRIPTION OF THE DRAWINGS

The example of the invention will be described with reference to the accompanying drawings in which.

DETAIL DESCRIPTION OF THE PREFERRED EXAMPLE

Figure 1:
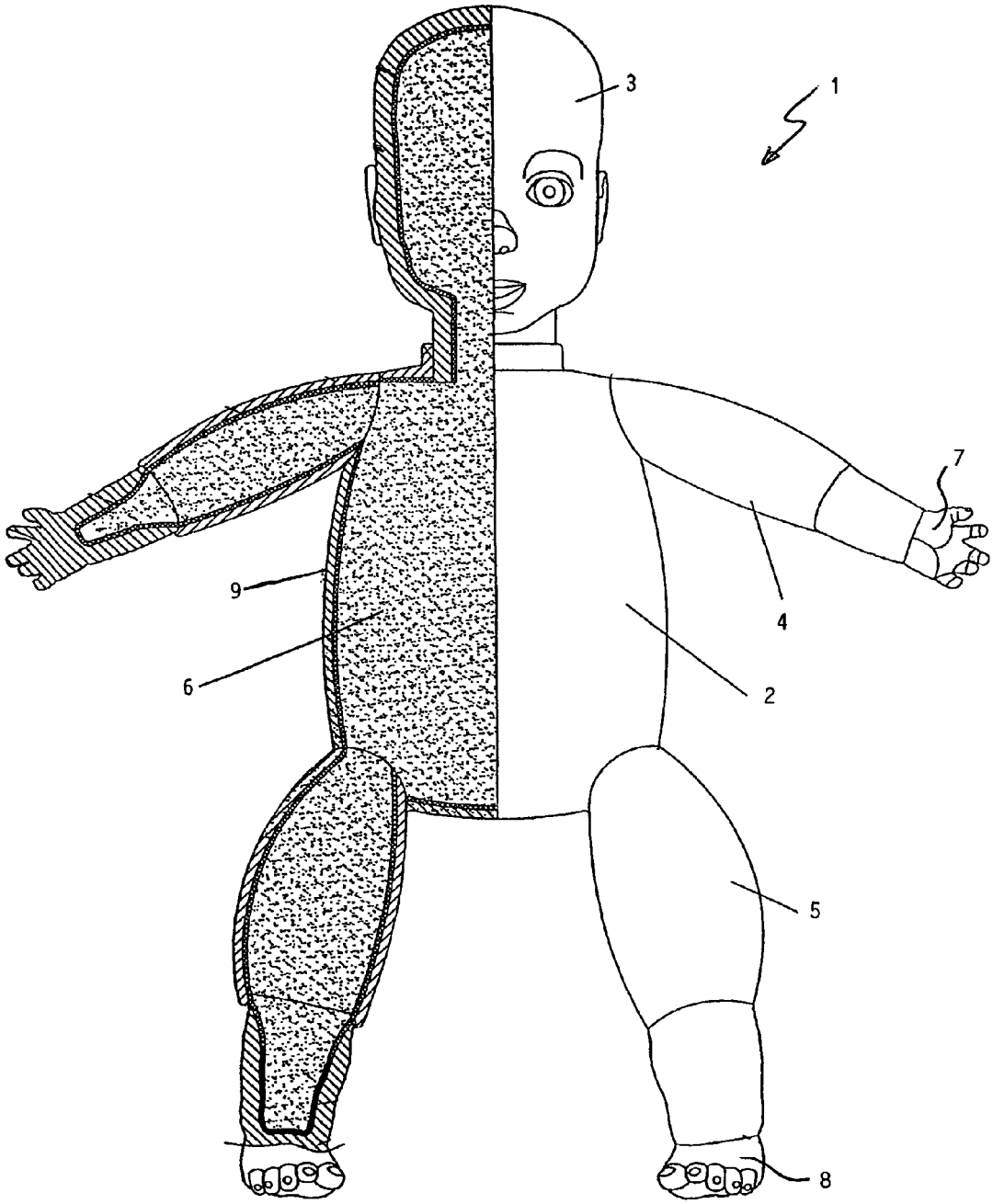
FIG. 1 is a schematic illustration of a doll according to the invention.

The drawings depict a doll 1 having a figure in a humanoid shape. It should be appreciated though that the invention is equally applicable to dolls having other animal or creature shapes. The doll 1 has a body or torso 2 with head 3, arms 4 and legs 5. The head 3 has features such as eyes, nose, mouth and ears on its exterior.

At the end of the arms 4 and legs 5 are hands 7 and feet 8 respectively.

The body 2, head 3, arms 4 and legs 4 all have a soft resilient inner core of cotton fiber 6 covered in an outer covering, or external skin 9. The outer covering has a skin-like appearance and characteristics with the ability to be compressed and to rebounded, and to be pitched and to return to the original state afterwards.

Figure 2:
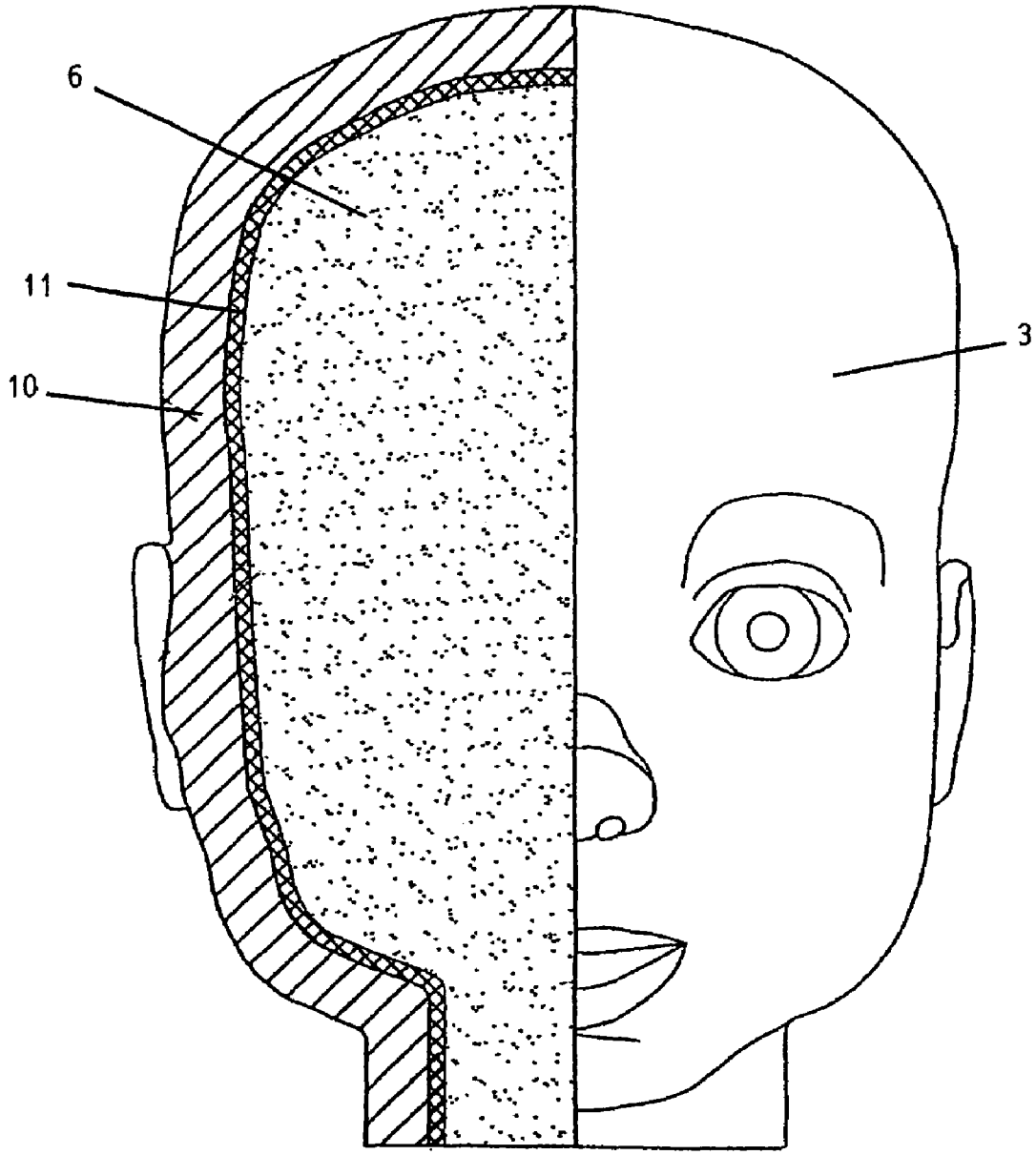
FIG. 2 is an enlarged view of the doll's head.
Figure 3:
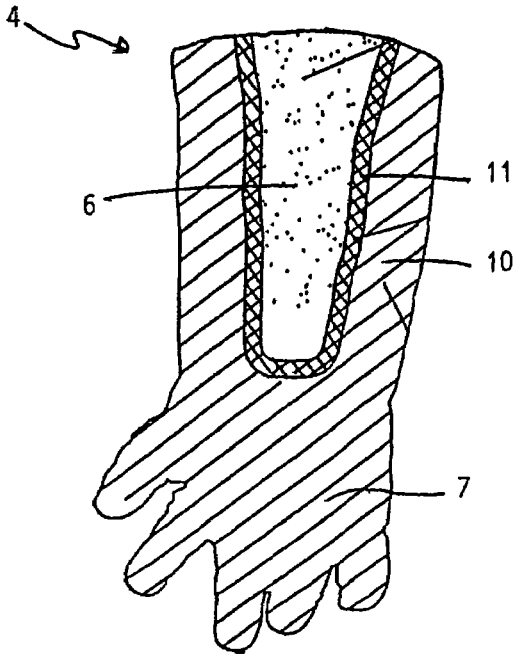
FIG. 3 is a section elevation view of the doll's arm and hand.
Figure 4:
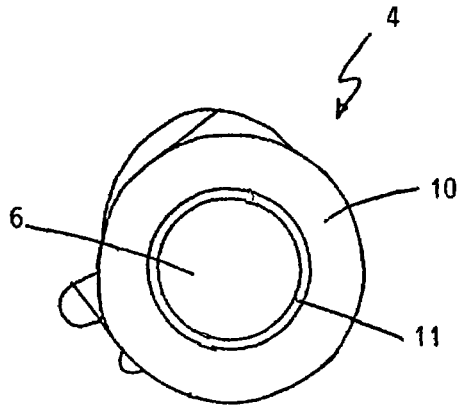
FIG. 4 is a section plan view of the arm.
Figure 5:
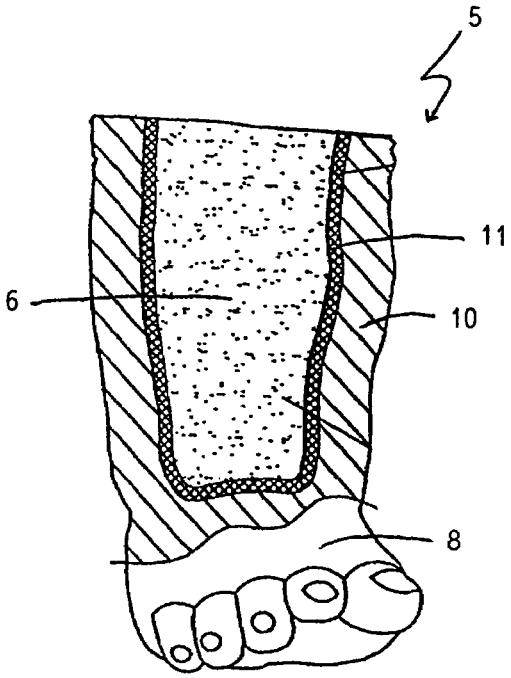
FIG. 5 is a section elevation of the doll's leg and foot.
Figure 6:
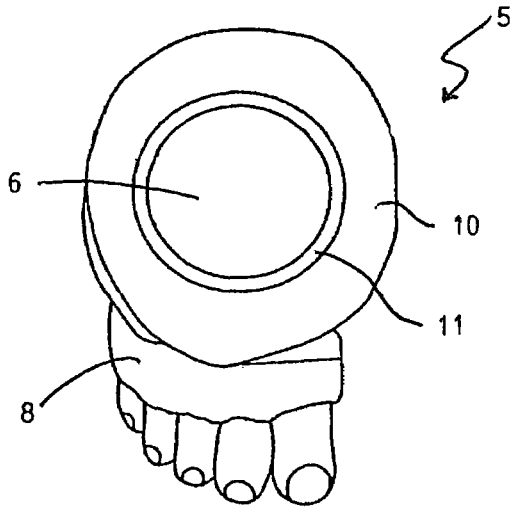
FIG. 6 is a section plan view of the leg.

Referring to FIGS. 2 through 6 for clarity, the outer covering 9 has two layers. An outer layer consists of soft and highly flexible gelatinous compound 10 having external skin-like characteristic which is bonded to an inner layer of elastic textile material 11. The outer gelatinous compound 10 is described in applicant's UK patent 2391869. This material consists of SEEPS or SEBS and a mineral oil in a ratio of between 1:5 and 1:30 and has its tackiness removed by the introduction of an antioxidant during the compounding process. To account for the flexibility of the outer compound 10 the inner textile 11 is a stretchy elastic textile such as Spandex or Elastine by DuPont. A common example of such a textile is LYCRA by INVISTA. The gelatinous compound and flexible textile are bonded together during molding.

A mold is produced in known-manner for forming the gelatinous material into the shape of the outer covering for the various figure parts such as body 2, head 3, arms 4 and legs 5. A thin layer of the elastic textile is located on the inner wall of the mold which is then sealed and the molten gelatinous compound injected into the mold. As the gelatinous compound sets it is fused to the surface of the textile. On ejection from the mold there is a preformed outer covering for doll parts, which are stuffed with the cotton fiber filling 6 and joined in known-manner. Alternatively, during making of the head 3 and limbs 4, 5 an excess piece of the textile material can be left exposed at the joint end for sewing to the body part 2.

The gelatinous compound has different thicknesses in different areas of the figure to more closely approximate the characteristic feel of human body. In firm areas of the body, such as arms 4 and legs 5 the gelatinous compound 10 layer is approximately 3-4 millimeters thick. In 'fatter' softer areas of the body, such as the face and certain areas of the body 2, the gelatinous compound 10 layer is approximately 10-15 millimeters thick to give a softer more realistic feel. The thickness of the gelatinous compound 10 layer is governed by the depth of the mold. Additionally, the molds for the limbs 4, 5 are formed such that the hands and feet at the distal ends of the limbs are entirely of the solid gelatinous compound 10 and have no cotton fiber filling 6.

It should be appreciate that modifications and alternations obvious to those skilled in the art are not to be considered as beyond the scope of the present invention. For example, the outer elastic compound may be of another type. Other suitable materials which are highly elastic and of comparable softness may be used which include:

Thermoplastic Rubber (TPR) compounds and alloy

Thermoplastic Polyurethane (TPU) compounds and alloys

Thermoplastic Vulcanizates (TPV) compounds and alloys

Thermoplastic Olefins (TPO) compounds and alloys

Poly Vinyl Chloride (PVC) compounds and alloys

Gelatinous compositions of Styrene Block Copolymers (SBC) Natural Rubber.

Additionally, in the preferred example the entire doll figure is constructed with the skin-like covering. However, in alternative embodiments only certain parts such as head, arms and legs which might be exposed outside doll's clothing would have the skin-like outer covering. And yet a further embodiment, the gelatinous compound may be preformed in molds and later glued to elastic textile material.

In other embodiments the inner filling may be less flexible or rigid or only applied to parts of the figure or the doll may be constructed of a hollow hard shell, and the gelatinous compound located directly over the shell.

What is claimed is:

1. A doll comprising a figure of a human or an animal having at least one soft part comprising a soft resilient material, and an outer cover covering the soft part, wherein the outer cover comprises an outer layer of flexible gelatinous compound having a different thickness in different areas of the figure, so as to provide a skin-like characteristic to the soft part, the outer layer being bonded to an inner layer of stretchy elastic textile.

2. The doll of claim 1 wherein the gelatinous compound was formed by a molding process and was bonded to the stretchy elastic textile during the molding process.

3. The doll of claim 1 wherein the gelatinous compound was formed by a molding process and is bonded to the stretchy elastic textile by an adhesive.

4. The doll of claim 1 wherein the stretchy elastic textile is a spandex or elastine.

5. The doll of claim 1 wherein the gelatinous compound is between 3 and 15 millimeters thick.

6. The doll of claim 1 wherein the gelatinous compound consists of SEEPS or SEBS and a mineral oil in a ratio of between 1:5 and 1:30.

7. The doll of claim 1 wherein tackiness of the gelatinous compound was removed by the introduction of an antioxidant during the compounding process.

* * * * *